US012448667B2

(12) United States Patent
Gil Fernández-Marcote et al.

(10) Patent No.: US 12,448,667 B2
(45) Date of Patent: Oct. 21, 2025

(54) ALUMINIUM ALLOY SHEET FOR CLOSURES AND THERMOMECHANICAL METHOD FOR PRODUCING THE SAME

(71) Applicant: ALUDIUM TRANSFORMACIÓN DE PRODUCTOS, S.L.U., Amorebieta-Etzano (ES)

(72) Inventors: Ignacio Gil Fernández-Marcote, Alicante (ES); Catalina Fernández Rivera, Alicante (ES)

(73) Assignee: ALUDIUM TRANSFORMACIÓN DE PRODUCTOS, S.L.U. (ES)

( * ) Notice: Subject to any disclaimer, the term of this patent is extended or adjusted under 35 U.S.C. 154(b) by 19 days.

(21) Appl. No.: 18/282,510

(22) PCT Filed: Mar. 15, 2022

(86) PCT No.: PCT/EP2022/056716
§ 371 (c)(1),
(2) Date: Sep. 15, 2023

(87) PCT Pub. No.: WO2022/194875
PCT Pub. Date: Sep. 22, 2022

(65) Prior Publication Data

US 2024/0158893 A1 May 16, 2024

(30) Foreign Application Priority Data

Mar. 18, 2021 (EP) ..... 21382222

(51) Int. Cl.
*C22C 21/00* (2006.01)
*C22F 1/04* (2006.01)

(52) U.S. Cl.
CPC ..... *C22C 21/00* (2013.01); *C22F 1/04* (2013.01)

(58) Field of Classification Search
None
See application file for complete search history.

(56) References Cited

U.S. PATENT DOCUMENTS 5,019,188 A * 5/1991 Hasenclever ..... C22C 21/00 148/552
5,116,428 A 5/1992 Hasenclever
(Continued)

FOREIGN PATENT DOCUMENTS

JP H05195171 8/1993
JP 2001181766 A 7/2001
(Continued)

OTHER PUBLICATIONS

European Communication of Third Party Observations dated Jan. 3, 2025 for corresponding European Application No. 22724646.9; 4 pages.

(Continued)

*Primary Examiner* — Daniel J. Schleis
(74) *Attorney, Agent, or Firm* — Snell & Wilmer LLP

(57) ABSTRACT

An aluminium alloy sheet includes an aluminium alloy, wherein the aluminium alloy includes: 0.15 wt. % to 0.25 wt. % of Si, 0.80 wt. % to 1.00 wt. % of Fe, 0.08 wt. % to 0.12 wt. % of Cu, 0.55 wt. % to 0.70 wt. % of Mn, 0.30 wt. % to 0.40 wt. % of Mg, equal to or less than 0.05 wt. % of each other element, and aluminium as balance. A thermomechanical method for producing such aluminium alloy sheet includes an specific scheme of heating and rolling stages; and the use of such aluminium alloy sheet for manufacturing an aluminium closure, preferably an aluminium cap, for bottles, cans or other similar containers.

18 Claims, 2 Drawing Sheets

(56) References Cited

U.S. PATENT DOCUMENTS

| | | | | |
|---|---|---|---|---|
| 2008/0302454 | A1* | 12/2008 | Kajihara | C22C 21/00 148/692 |
| 2016/0288195 | A1 | 10/2016 | Rostaing et al. | |

FOREIGN PATENT DOCUMENTS

| | | | |
|---|---|---|---|
| JP | 2007191760 | A | 8/2007 |
| JP | 2011202240 | A | 10/2011 |
| KR | 101306515 | B1 | 9/2013 |

OTHER PUBLICATIONS

Patrick Deneuville; "Mise en forme de l'aluminium—Laminage"; Techniques De L'Ingenieur, Ref. No. M3140 V1; Published on Jun. 10, 2010; 27 pages; English Abstract; cited in European Communication of Third Party Observations dated Jan. 3, 2025 for corresponding European Application No. 22724646.9.

"Prior sale Aug. 10, 2020" (NPL2) cited in European Communication of Third Party Observations dated Jan. 3, 2025 for corresponding European Application No. 22724646.9.

"2.1. Prior use (1) When did the prior use occur? Aug. 10, 2020 What was made available? 15.300 KG (15,3 tons) of an aluminum alloy having the following composition, in wt.%. Si: 0,201, Fe: 0,909, Cu: 0,096, Mn: 0,645, Mg: 0,347, Cr: 0,005, Ti: 0,028, in the form of sheets (Nr 2016873 and 2016874) having a thickness of 0.35 mm and a width of 1465 mm. Where was it made available? Weinburg Austria" cited in European Communication of Third Party Observations dated Jan. 3, 2025 for corresponding European Application No. 22724646.9.

International Search Report in related patent application PCT/EP2022/056716 prepared by the European Patent Office and having a date of mailing of Aug. 19, 2022, 3 pgs. in English.

Written Opinion of the International Searching Authority in related patent application PCT/EP2022/056716 prepared by the European Patent Office and having a date of mailing of Aug. 19, 2022, 3 pgs. in English.

* cited by examiner

ALUMINIUM ALLOY SHEET FOR CLOSURES AND THERMOMECHANICAL METHOD FOR PRODUCING THE SAME

CROSS-REFERENCE TO RELATED APPLICATIONS

This application is a national stage under 35 U.S.C. § 371 of PCT patent application PCT/EP2022/056716 filed on 15 Mar. 2022, which is pending and which is hereby incorporated by reference in its entirety for all purposes. PCT/EP2022/056716 claims priority to European patent application EP 21382222 filed 18 Mar. 2021, which is hereby incorporated by reference in its entirety for all purposes.

FIELD OF THE INVENTION

The present invention belongs to the technical field of the aluminium industry and, more specifically, it provides an aluminium alloy sheet particularly useful for manufacturing closures for bottles, cans or other similar containers. Additionally, the invention refers to a thermomechanical method for producing such aluminium alloy sheet.

BACKGROUND OF THE INVENTION

The manufacturing of aluminium closures of bottles, cans or other similar containers, particularly those to be used in the food or pharmaceutical industry for storing edible liquids such as medicines, wine, olive oil, vinegar, spirits or water, is in continuous evolution to achieve the highest commitment in environmental impact, while maintaining the maximum quality levels, in particular strength, formability, anisotropy (earing), as well as a smooth and homogeneous surface.

Thickness downgauging is a goal to reduce the material volume and, additionally, obtain an aluminium alloy having a higher recyclability rate. However aluminium alloys commonly used for manufacturing closures such as aluminium caps, usually alloys 3105A or 8011A according to International standards (i.e., the Aluminium Association (AA) standards, the European standards (EN) and/or the International standards (ISO)) are not able to properly satisfy the quality requirements of the final product, because they cannot simultaneously present the required formability to be deep drawn and the required mechanical properties, in particular a high strength. On the one hand, the deep drawing quality needed to manufacture aluminium closures, in particular aluminium caps, cannot be achieved when using harder tempers from the same conventional alloy. On the other hand, those aluminium alloys having a suitable deep drawing quality are not able to achieve the necessary strength in the final product, in particular regarding the rigidity of the closure. Thus, the strength of alloys 3105A and 8011A conventionally used in the art cannot be increased by using harder tempers, because it provokes high isotropy which is not compatible with the required quality of aluminium closures for bottles, cans or other similar containers.

Some attempts to obtain aluminium alloy plates for bottle closures, in particular for manufacturing pilfer proof caps (PP caps) are described, for example, in patent documents JP2007191760 and JP2011202240. More specifically, JP2007191760 describes an aluminium alloy plate for a PP cap, which can suppress a change in ear ratio to a low level without performing recrystallization annealing after hot rolling. This prior art document describes an aluminium alloy plate for PP cap having 0.3 mass % or less of Cu, 0.2 to 0.5 mass % of Mn, 0.2 to 0.6 mass % of Mg, 0.1 to 0.3 mass % of Si, 0.2 to 0.7 mass % of Fe, and the balance being Al and unavoidable impurities. According to JP2007191760, the aluminium alloy plate therein described is manufactured by a method including a preliminary homogenization heat treatment stage for performing preliminary homogenization heat treatment under the conditions of: 550 to 630° C. and holding time: 1 to 10 hours, and a chamfering stage for chamfering the surface of the pre-homogenized heat treated slab. After that, the method comprises a homogenization heat treatment stage of carrying out the homogenized heat treatment at the holding temperature: 450 to 530° C. for 1 to 10 hours, the homogenized slap is then hot rolled, wherein the rolling end temperature is of 380° C. to 300° C. to obtain a hot rolled sheet, and the hot rolled sheet is cold rolled at a reduction ratio of 50 to 90% to obtain a cold rolled sheet. Intermediate annealing of the cold-rolled sheet at a temperature rising rate of 10° C./sec or more, a holding temperature of 400 to 530° C., a holding time of 0 to 10 seconds, and a temperature lowering rate of 10° C./sec or more. After that, the annealed sheet is subjected to finish cold rolling at a reduction ratio of 10 to 60% to obtain a finish cold rolling sheet, and a finish annealing stage of producing an aluminium alloy sheet, wherein the rolled sheet is heated at a holding temperature of 200 to 260° C. and a holding time of 1 to 4 hours.

According to document JP2011202240, the cap winding formability of the aluminium alloy described in JP2007191760 is deteriorated in a high-strength material having a tensile strength of more than 200 MPa. Thus, the objective of JP2011202240 is to provide a higher strength aluminium alloy plate, while maintaining formability of the aluminium alloy plate described in JP2007191760. To solve this technical problem, the aluminium alloy plate of JP2007191760 is modified by increasing the amount of Cu to 0.3-0.5% mass %, so that the aluminium alloy plate obtained has a tensile strength of 200 to 240 MPa in the plate width direction of the tensile strength. The manufacturing method described in this prior art document is basically the same as described in previous patent document JP2007191760.

However, there is still a need to provide an improved aluminium alloy sheet for the purpose of thickness downgauging the closure sheets, which present the required levels of strength, formability and anisotropy to be used in the manufacture of closures or caps for bottles, cans or other similar containers. Besides that, there is also a need to improve the recyclability of the aluminium alloy sheet.

There is also a need to provide a method specifically adapted for producing the aluminium alloy sheet of the invention. In particular, a method which can be carried out in conventional equipment commonly used in the manufacture of aluminium alloy sheets.

BRIEF DESCRIPTION OF THE INVENTION

The present invention advantageously provides an aluminium alloy sheet with an improved thickness downgauging, so that the final thickness of the sheet may be lower than 0.190 mm, in particular from 0.1725 mm to 0.1875 mm, which can achieve strength according to namely H1ST temper which has been defined according to the standards as H1X or H2X (X≥1/2 hard) and, additionally, shows an increased recyclability rate which allows both internal and external scraps to be recycled.

Thus, one aspect of the current invention refers to an aluminium alloy sheet comprising an aluminium alloy, wherein the aluminium alloy comprises:

0.15 wt. % to 0.25 wt. % of Si,
0.80 wt. % to 1.00 wt. % of Fe,
0.08 wt. % to 0.12 wt. % of Cu,
0.55 wt. % to 0.70 wt. % of Mn,
0.30 wt. % to 0.40 wt. % of Mg,
equal to or less than 0.05 wt. % of each other element, preferably equal to or less than 0.03 wt. %, and
aluminium as balance.

As previously mentioned in this document, aluminium alloys commonly used for closures are usually according to the International standards 3105A or 8011A. However, the inventors surprisingly found that the aluminium alloy described herein, which is according to a different alloy in the standards not previously used for this purpose (i.e., AA 8026), has the proper amounts of all alloying elements required to achieve, in particular when manufactured according to the method described in this document, an improved aluminium alloy sheet with the desired thickness downgauging, which additionally presents the required levels of strength, formability, anisotropy and recyclability rates for closure sheets. Another important advantage of the instant invention is that the aluminium alloy sheet described herein may present smooth and homogeneous surface, another important requirement in order to use the sheet in the manufacturing of aluminium closures of bottles, cans or other similar containers.

Another aspect of the present invention refers to a method for producing the aluminium alloy sheet as described in this document, wherein the method comprises:

a) obtaining an aluminium alloy ingot comprising an aluminium alloy as described in this document;
b) homogenizing the aluminium alloy ingot to form a homogenized ingot by heating the aluminium alloy ingot at a temperature of 530° C. to 610° C. for at least 4 hours, preferably at least 9 hours;
c) hot rolling the homogenized aluminium alloy ingot to form a hot rolled sheet, wherein the final hot rolling temperature is of 330° C. to 390° C.;
d) a first cold rolling stage, wherein the hot rolled sheet is cold rolled, preferably at a temperature lower than 100° C., to form a first cold rolled sheet, wherein the first cold rolling is done with a thickness reduction of 25% to 85%;
e) a first recrystallization annealing stage, wherein the first cold rolled sheet is annealed at a temperature of 300° C. to 450° C. for 0.5 hours to 6 hours to form a first annealed sheet;
f) a second cold rolling stage, wherein the first annealed sheet is cold rolled, preferably at a temperature lower than 100° C., to form a second cold rolled sheet, wherein the second cold rolling is done with a thickness reduction of 25% to 85%;
g) a second recrystallization annealing, wherein the second cold rolled sheet is annealed at a temperature of 300° C. to 450° C. for 0.5 hours to 6 hours to form a second annealed sheet;
h) a third cold rolling stage, wherein the second annealed sheet is cold rolled, preferably at a temperature lower than 100° C., to form a third cold rolled sheet, wherein the third cold rolling is done with a thickness reduction of 25% to 85%; and
i) optionally, stabilization annealing the third cold rolled sheet to form the final aluminium alloy sheet, wherein the annealing is at a temperature of 180° C. to 225° C. for 5-15 seconds.

The method for manufacturing an aluminium alloy sheet of the invention combines the chemical composition of the aluminium alloy with a specifically adapted scheme of stages including, in particular, adequate hot and cold rolling reductions with interannealing treatments. As a result of this combination, it is possible to produce an aluminium alloy sheet with an improved thickness down-gauging and, additionally, the required properties to be used for manufacturing closures for bottles, cans and other similar containers.

Thus, a further aspect of the present invention refers to an aluminium alloy sheet as described in this document, characterized in that the sheet is obtained or obtainable by the method according to the invention.

An additional aspect of the invention refers to the use of the aluminium alloy sheet described in this document for manufacturing an aluminium closure, preferably an aluminium cap. These caps may be short caps such as screw cap or pilfer proof caps, or they may be long caps such as wine caps.

A further aspect of the instant invention refers to the aluminium closure comprising the aluminium alloy sheet defined in this document. In particular, these closures are caps as those mentioned in the previous paragraphs.

The aluminium closure according to the invention may be used for bottles, cans or other similar containers, particularly those to be used in the food or pharmaceutical industry for storing edible liquids such as medicines, wine, olive oil, vinegar, spirits or water.

DETAILED DESCRIPTION OF THE INVENTION

One aspect of the invention described herein refers to an aluminium alloy sheet comprising an aluminium alloy, wherein the aluminium alloy comprises:

0.15 wt. % to 0.25 wt. % of Si,
0.80 wt. % to 1.00 wt. % of Fe,
0.08 wt. % to 0.12 wt. % of Cu,
0.55 wt. % to 0.70 wt. % of Mn,
0.30 wt. % to 0.40 wt. % of Mg,
equal to or less than 0.05 wt. % of each other element, preferably equal to or less than 0.03 wt. %, and
aluminium as balance.

The aluminium alloy sheet of the invention may have different sizes, so that it may be presented as a coil or, alternatively, as separate individual sheets that can be stacked one on top of the other.

The aluminium alloy described herein may further comprise other elements such as Ti, Cr, Zn, Pb and/or other unspecified elements. These additional chemical elements may be unavoidable impurities from the starting material used for manufacturing the aluminium alloy sheet of the invention, either the bauxite used to obtain aluminium by electrolysis (primary aluminium) or the scrap metal to be recycled (secondary aluminium). In any case, the amount of each one of these other elements is equal to or lower than 0.05 wt. %, so that they do not negatively affect the properties of the aluminium alloy sheet. Particularly, higher amounts of Cr and/or Ti may negatively affect the mechanical properties of the aluminium alloy sheet due to the formation of second phases. In order to avoid this negative effect in the mechanical properties, the amount of Cr and Ti is preferably reduced to an amount equal to or less than 0.03 wt. %.

Thus, in preferred embodiments of the invention, the aluminium alloy may also comprise:

equal to or less than 0.03 wt. % of Cr,
equal to or less than 0.05 wt. % of Zn,
equal to or less than 0.03 wt. % of Ti, and
equal to or less than 0.03 wt. % of each other element, wherein the total amount of unspecified elements is equal to or less than 0.15 wt. %.

In the particular case of titanium (Ti), this element may also be present in the aluminium alloy as grain refiner. Therefore, in preferred embodiments of the invention, the amount of Ti in the aluminium alloy may range from 0.01 wt. % to 0.03 wt. %, more preferably from 0.015 wt. % to 0.025 wt. % in order to refine the grains of the ingot, resulting in an improvement of the formability of the aluminium alloy sheet of the invention. If the Ti content is too high, giant Al—Ti-based intermetallic compounds will be formed by crystallization and impair the formability.

Preferably, the amount of Pb in the aluminium alloy according to the invention is equal to or lower than 0.010 wt. %, so that the aluminium alloy sheet described in this document complies with the requirements for food contact products of the European Standard EN602:2004, which specifies the maximum percentage content of alloying elements and impurities present in wrought aluminium and aluminium alloys which are fabricated into materials and articles designed to be in contact with food, as well as other current packaging legislations such as European Directive 94/62/EC, or those established by the Coalition of Northeasters Governors (CONEG) or the Food and Drug Administration (FDA) in the United States.

In the frame of this invention, the term "unspecified elements" refers to chemical elements different from those specified herein (i.e., Si, Fe, Cu, Mn, Mg, Cr, Zn, Ti or Pb) that might be present in the aluminium alloy according to the invention, usually as unavoidable impurities from the starting material used for manufacturing the aluminium alloy sheet of the invention, either the material used to produce aluminium (bauxite) or the scrap metal to be recycled. As previously mention in this document, each one of these unspecified chemical elements may be present in the aluminium alloy in an amount equal to or less than 0.05 wt. %, preferably equal to or less than 0.03 wt. %, wherein the total amount of unspecified elements is equal to or less than 0.15 wt. %. The content of unspecified elements in the aluminium alloy sheet of the invention can be measured and controlled by spectrometry.

Both silicon (Si) and iron (Fe) can generate intermetallic particles with aluminium (Al) and, additionally, with manganese (Mn). In the aluminium alloy sheet of the invention, anisotropy (earing) can be controlled with the amount of Si, Fe and the Fe/Si ratio in the aluminium alloy, because these features impact on recrystallization, grain size and texture of the aluminium alloy sheet, in particular when it is obtained or obtainable by the method described herein. Thus, the content of Fe is preferably set in accordance with the content of Si, so that the mass ratio of Fe and Si (Fe/Si) is higher than 3, more preferably higher than 4.

The aluminium alloy of the invention comprises from 0.15 wt. % to 0.25 wt. % of Si. If the content of Si is lower than 0.15 wt. %, the effect of this element in reducing earing is inhibited and, therefore, it is difficult to achieve an aluminium alloy sheet with the required earing values, preferably less than 3%, and more preferably less than 2.5%. On the other hand, a content of Si higher than 0.25 wt. % increases intermetallic size and segregation of Si can occur in the matrix, which would also negatively affect the adjustment of earing to the required values and, consequently, the drawability of the aluminium alloy sheet. In particular embodiments of the invention, the amount of Si may range from 0.16 wt. % to 0.21 wt. % of Si, more specifically from 0.155 wt. % to 0.205 wt. %, in order to achieve a better adjustment of the anisotropy (i.e., reduced earing) of the aluminium alloy sheet.

The aluminium alloy also comprises from 0.80 wt. % to 1.00 wt. % of Fe. If the content of Fe is lower than 0.80 wt. %, it tends to coarse the grain and jeopardize earing adjustment to the required values, preferably less than 3%, and more preferably less than 2.5%. On the other hand, an amount of Fe higher than 1.00 wt. % increases intermetallic size and negatively affect the adjustment of earing to the required values and, consequently, the drawability of the aluminium alloy sheet. In particular embodiments of the invention, the amount of Fe may range from 0.83 wt. % to 0.93 wt. % of Fe to achieve a better adjustment of the anisotropy (i.e., reduced earing) of the aluminium alloy sheet.

Copper (Cu) increases the strength of the aluminium alloy sheet. A minimum amount of 0.08 wt. % is required to secure an strengthens effect. However, the maximum amount of Cu in the aluminium alloy according to the invention has to be restricted to 0.12% wt. in order to control strength and, therefore, achieve the desired balance between strength and formability in the aluminium alloy sheet described herein, since formability of the aluminium alloy sheet decreases in increasing strength.

Manganese (Mn) also increases the strength of the aluminium alloy sheet through solid solution and intermetallic compound with Al and Fe and Si. If the content of Mn is lower than 0.55 wt. %, the strength of the final product can be negatively affected. If it exceeds 0.70 wt. %, however, the formability decreases. In particular embodiments of the invention, the amount of Mn may range from 0.60 wt. % to 0.66 wt. % of Mn to achieve and improved balance between strength and formability.

Magnesium (Mg) increases the strength of the aluminium alloy sheet. A content of Mg lower than 0.30 wt. % cannot secure enough strength, but the maximum content of Mg in the aluminium alloy according to the invention has to be restricted to 0.40% wt. to control strength and, therefore, achieve the desired balance between strength and formability in the aluminium alloy sheet described herein, since formability of the aluminium alloy sheet decreases in increasing strength. In particular embodiments of the invention, the amount of Mg may range from 0.30 wt. % and 0.38 wt. %, more specifically from 0.305 wt. % to 0.375 wt. % in order to achieve an improved balance between strength and formability.

In particular embodiments of the invention, the aluminium alloy sheet described herein comprises an aluminium alloy comprising:

0.16 wt. % to 0.21 wt. % of Si,
0.83 wt. % to 0.93 wt. % of Fe,
0.08 wt. % to 0.12 wt. % of Cu,
0.60 wt. % to 0.66 wt. % of Mn,
0.30 wt. % to 0.38 wt. % of Mg,
equal to or less than 0.03 wt. % of Cr,
equal to or less than 0.05 wt. % of Zn,
equal to or less than 0.03 wt. % of Ti, preferably from 0.01 wt. % to 0.03 wt. % of Ti,
equal to or less than 0.010 wt. % Pb, equal to or less than 0.03 wt. % of each other element, wherein the total amount of unspecified elements is equal to or less than 0.15 wt. %, and aluminium as balance.

This aluminium alloy sheet, in particular if it is obtained or obtainable by the method described herein, is particularly suitable for the manufacturing of closures and caps for bottles, cans or other similar containers, particularly those to be used in the food or pharmaceutical industry for storing edible liquids such as medicines, wine, olive oil, vinegar, spirits or water, because it allows a higher downgauging, since this aluminium sheet presents optimised levels of strength, formability and anisotropy. Moreover, the aluminium alloy sheet of the invention has an optimised recyclability rate, which makes this sheet even more useful for the manufacturing of the above-mentioned closures and caps.

In particular embodiments of the invention, the aluminium alloy sheet has a thickness equal to or lower than 0.190 mm, preferably from 0.1725 mm to 0.1875 mm. The thickness of aluminium sheets based on 3105A to be used in the manufacture of short caps is usually defined as a minimum thickness of 0.215 mm, whereas sheets of aluminium alloys based on 8011A commonly used for manufacturing long caps such as wine type caps usually has a thickness of 0.225 mm. This thickness cannot be reduced, because it is not possible to improve the mechanical properties of these aluminium alloy sheets without negatively affect the anisotropy. Due to the optimised balance between mechanical properties, anisotropy and formability of the aluminium alloy sheet of the instant invention, the thickness can be significantly reduced, thus reducing the environmental impact and economical cost associate with aluminium closures comprising such aluminium alloy sheet.

As previously mentioned in this document, the aluminium alloy sheet of the invention shows a reduced anisotropy. More specifically, the aluminium alloy sheet according to the invention may have an earing of less than 3%, preferably of less than 2.5%, measured according to UNE EN 1669: 1997, although other equivalent methods such as the one described in the standard ISO 11531:2015 may also be used. This method measures the height of the highest parts (also called ears) and the height of the lowest regions (also called troughs), the percentage corresponds to the difference of heights between ears and troughs with respect to the medium height of the cup.

Earing is the result of non-uniform formability caused by anisotropy of the aluminium alloy sheet during deep-drawing. Thus, as a result of different radial elongations in different directions of the metal sheet, earing (i.e., undesired wavy edges) is formed during deep-drawing. If the earing is equal to or higher than 3%, some problems may arise in the manufacture of aluminium closures for bottles, in particular aluminium caps such as short caps, long caps or PP caps. One of the main problems associated with a high earing is that the manufacture of closures of bottles with a desired height and, sometimes even the equipment used to do it, requires some modifications which may negatively affect cost and effectiveness of the manufacturing process. Due to the lack of material in the troughs formed during the deep-drawing, aluminium alloy discs of a greater diameter are needed for manufacturing the closure with the required height, so that the portion with a reduced amount of metal can be cut after deep-drawing. As previously mentioned, this results in a lack of material which negatively affects the cost and effectiveness of the manufacturing process.

In particular embodiments of the invention, the strength of the aluminium alloy sheet complies with the requirements of the H1ST temper which has been defined according to the standards as H1X or H2X (X≥1/2 hard). More specifically, it preferably has a tensile strength (Rm) of 175 MPa to 215 MPa, a yield strength (Rp0.2) of 170 MPa to 210 MPa, and elongation (A50) equal to or higher than 2%, measured according to the norm UNE-EN ISO 6892-1:2020.

After stoving simulation according to the norm UNE-EN-541:2008 (205° C. for 20 minutes) in order to reproduce the conventional treatment for curing of lacquers and paints, the aluminium alloy sheet of the invention preferably has a tensile strength (Rm) of 165 MPa to 205 MPa, a yield strength (Rp0.2) of 150 MPa to 190 MPa, and elongation (A50) equal to or higher than 3%, measured according to the norm UNE-EN ISO 6892-1:2020.

In some embodiments of the invention, the grain size of the aluminium alloy sheet is lower than 100 μm, preferably lower than 75 μm, measured in the plane of the long transverse direction by interception method according to ASTM E-112.

As previously mentioned in this document, one of the important advantages of the aluminium alloy sheet of the instant invention is that it can be recycled. In particular, it might be used as secondary aluminium in the manufacturing method described herein.

Another aspect of the present invention refers to a method for producing the aluminium alloy sheet as described in this document, wherein the method comprises:

a) obtaining an aluminium alloy ingot comprising an aluminium alloy as described in this document;

b) homogenizing the aluminium alloy ingot to form a homogenized ingot by heating the aluminium alloy ingot at a temperature of 530° C. to 610° C. for at least 4 hours, preferably at least 9 hours;

c) hot rolling the homogenized aluminium alloy ingot to form a hot rolled sheet, wherein the final hot rolling temperature is of 330° C. to 390° C.;

d) a first cold rolling stage, wherein the hot rolled sheet is cold rolled, preferably at a temperature lower than 100° C., to form a first cold rolled sheet, wherein the first cold rolling is done with a thickness reduction of 25% to 85%;

e) a first recrystallization annealing stage, wherein the first cold rolled sheet is annealed at a temperature of 300° C. to 450° C. for 0.5 hours to 6 hours to form a first annealed sheet;

f) a second cold rolling stage, wherein the first annealed sheet is cold rolled, preferably at a temperature lower than 100° C., to form a second cold rolled sheet, wherein the second cold rolling is done with a thickness reduction of 25% to 85%;

g) a second recrystallization annealing, wherein the second cold rolled sheet is annealed at a temperature of 300° C. to 450° C. for 0.5 hours to 6 hours to form a second annealed sheet;

h) a third cold rolling stage, wherein the second annealed sheet is cold rolled, preferably at a temperature lower than 100° C., to form a third cold rolled sheet, wherein the third cold rolling is done with a thickness reduction of 25% to 85%; and i) optionally, stabilization annealing the third cold rolled sheet to form the final aluminium alloy sheet, wherein the annealing is at a temperature of 180° C. to 225° C. for 5-15 seconds.

The method for manufacturing an aluminium alloy sheet of the invention combines the chemical composition of the aluminium alloy with a specifically adapted scheme of stages including, in particular, adequate hot and cold rolling reductions with interannealing treatments. As a result of this combination of technical features, it is possible to produce an aluminium alloy sheet with an improved thickness reduction of the aluminium alloy sheet and, additionally, the required properties to be used for manufacturing closures of bottles, cans and other similar containers.

In the method for producing an aluminium alloy sheet of the invention, stage a) comprises obtaining an aluminium alloy ingot comprising an aluminium alloy chemical composition as described in this document. This ingot is usually obtained by Direct Child Casting (also known as DC casting) according to standards commonly used in the aluminium industry and, preferably, scalping the surface to remove surface oxidation, as well as physical or structurally irregularities.

Although pure metals can be used to produce an ingot with the required chemical composition by Direct Child Casting, the method described herein may also be carried out using some amount of aluminium scrap as starting material, thus improving the recyclability rate of the aluminium alloy sheet. According to these embodiments of the invention, the aluminium scrap to be recycled may be mixed with the required amounts of pure metal, alloying elements and/or other aluminum alloys to achieve an aluminium alloy with the desired chemical composition in the DC Casting stage. Any type of aluminum scrap may be used as starting material, provided that the aluminum ingot obtained in stage a) comprises the aluminum alloy according to the invention.

In particular embodiments of the invention, aluminum scrap used as starting material may be aluminum scrap generated in previous cycles of the method according to the invention, but other scraps such as those generated in other processes of the same factory, as well as pre-consumer or post-consumer scrap types can also be used. Advantageously, aluminum alloy sheet based on International standards 3105A and 8011A conventionally used in manufacturing closures for bottles can also be recycled in the method of the invention, which is not always easy or even possible with these aluminum alloys.

Preferably, the recycling content (% RC) is equal to or higher than 75%, wherein the recycling content is the amount of material from aluminium scrap present in the aluminium ingot obtained in stage a) and can be measured according to the norm ISO 14021:2016, wherein different types of aluminium scraps that can be used as starting material in the method of the invention are also defined.

In the method for producing an aluminium alloy sheet according to the invention, the aluminium ingot obtained in stage a) is heated at a temperature of 530° C. to 610° C. for a period of at least 4 hours, preferably at least 9 hours, and more preferably from 9 hours to 40 hours. This stage is important because it allows the homogenization of the microstructure and, additionally, eliminates segregation. Besides that, this pre-heating or homogenization stage is important in determining the grain structure, and it affects isotropy and grain size of the final aluminium alloy sheet.

The homogenization temperature may be achieved by heating the aluminium ingot of stage a) at a heating rate of 25° C./h to 150° C./h, in particular the heating rate may be 100° C./h.

In particular embodiments of the invention, the homogenizing treatment of stage b) may comprise heating the ingot at a temperature of 540° C. to 560° C., in particular for a period of 4 h to 40 h, since these conditions help to achieve an aluminium alloy sheet with the required anisotropy, in particular earing of less than 3%, and more specifically earing of less than 2.5%, and are particularly useful in order to remove segregations and homogenize the microstructure.

The method according to the invention also comprises the hot rolling of the homogenized aluminium alloy at a final temperature of 330° C. to 390° C., preferably of 360° C. to 390° C., to form a hot rolled sheet. This stage is important in order to control grain size, uniformity and surface quality such as hot mill pick up. The temperature is controlled to get self-annealing and recrystallization at least at the end of the process. In particular, some surface quality issues may occur, if the final temperature is outside this range. If the final hot-rolling temperature is lower than 330° C., a duplex microstructure with partial recrystallization may be generated, which would negatively affect the anisotropy of the final product. If the final hot-rolling temperature is higher than 390° C., however, the surface quality of the final aluminum alloy sheet can be jeopardized due to the presence of pickup and surface oxidation.

The initial temperature of the hot rolling process may be higher than 450° C. As the sheet is rolled and the thickness reduced, the temperature is gradually decreased until the final temperature of 330° C. to 390° C., preferably of 360° C. to 390° C. In particular embodiments of the invention, the temperature may be maintained as higher as possible during the hot rolling stage, for example, by adjusting the pass schedule and the rolling speed.

In some embodiments of the invention, the thickness reduction achieved in this hot rolling stage is higher than 98%. The pass schedule can be adjusted according to procedures commonly known in the aluminium industry to achieve the desired thickness reduction and self-annealing to get the desired grain size, preferably lower than 100 μm, at the end of the hot-rolling stage.

The method for producing an aluminium alloy sheet of the invention comprises three different cold rolling stages, separated from each other by recrystallization annealing.

Cold rolling is usually referred to as a rolling process which takes place at a temperature lower than the recrystallization temperature, i.e., lower than 250° C. Typically, the temperature of cold rolling is lower than 100° C.

Thickness reductions in the cold rolling stages d), f) and h) are of 25% to 85%, preferably the thickness reduction is of 60% to 85% in the first cold rolling stage d), 60% to 85% in the second cold rolling stage f), and 25% to 60% in the third cold rolling stage h). More preferably, the thickness reduction is of 78% to 82% in the first cold rolling stage d), 68% to 72% in the second cold rolling stage f), and 48% to 52% in the third cold rolling stage h). These reductions are higher than those previously used in alloys 3105A and 8011A, thus achieving an increase in the mechanical properties of the final product without jeopardizing the anisotropy and formability of the material. Suitable values of these three properties (mechanical, anisotropy and formability) cannot be obtained with alloys 3105A and 8011A conventionally used for manufacturing closures for bottles, cans and other similar containers. This modification in thickness reduction is needed in order to increase the rigidity of the final product, thus obtaining a resistance equivalent to the product currently used for this kind of application. The combination of thermal treatments and thickness reduction in the thermomechanical process of the invention also provides an anisotropy lower enough to manufacture closures or caps in deep drawing processes and re-drawing in two or more steps, using conventional equipment to maintain productivity and losses associated with the products manufactured using conventional alloys.

The thickness reduction of the three different cold rolling stages may be balance to adjust earing and mechanical properties of the final product, in particular to have earing of less than 3% and, at the same time, comply with the mechanical requirements of a tensile strength (Rm) of 175 MPa to 215 MPa, a yield strength (Rp0.2) of 170 MPa to 210 MPa, and elongation (A50) equal to or higher than 2. Due to the specific sequence of cold-rolling and anneals treatments stages in the method of the invention, wherein there are three different cold rolling stages d), f) and h) separate each of them by recrystallization annealing treatments (stages e) and g)), the mechanical properties and anisotropy can be easily adjusted, so that the homogeneity of these properties in the aluminum alloy sheet of the invention is increased.

As previously mentioned, the method of the invention comprises two recrystallization annealing stages, wherein the aluminium alloy sheet is heated at a temperature from 300° C. to 450° C. for 0.5 hours to 6 hours. In any of these stages the metal is recrystallized to obtain a recrystallized, uniform and fine grain material.

In particular embodiments of the invention, the recrystallization annealing of one or more of stages e) and g) may be preferably carried out at a temperature from 320° C. to 360° C., more preferably from 320° C. to 340° C., for 2 hours to 4 hours. A temperature equal to or higher than 320° C. ensures 100% recrystallization, whereas a temperature equal to or lower than 360° C. and, in particular equal to or lower than 340° C., avoids grain growth and oxidation during the annealing treatment. Consequently, these are preferred temperature ranges because they combine a suitable grain size and a suitable surface quality.

The method for producing an aluminium alloy sheet of the invention may also comprise a stabilization annealing stage i), wherein the third cold rolled sheet is annealed at a temperature of 180° C. to 225° C. for 5-15 seconds. Outside this temperature range, the mechanical properties of the sheet may be negatively affected. On the one hand, if the temperature is higher than 225° C., the strength of the aluminium alloy sheet may be decreased due to the softness of the metal. On the other hand, if the stabilization annealing stage i) is carried out at a temperature lower than 180° C., the final strength of the sheet may be too high. The stabilization annealing stage i) is a continuous annealing process. Typically, this stage is carried out in a continuous furnace which allows a greater control of both the temperature and the residence time, which is only a few seconds.

In particular embodiments of the invention, the method described herein may comprise a stabilization annealing stage i), wherein the third cold rolled sheet is annealed at a temperature of 190° C. to 210° C. for 7-13 seconds.

Optionally, this stabilization annealing stage may be carry out in a different facility, in particular, it may be carried out by the manufacturer of closures of bottles, since it is equivalent to the conventional treatment for curing of lacquers and paints according to the norm UNE-EN 541:2008 (205° C., for 20 minutes). Therefore, the method according to the invention may comprise stages a) to h) as described herein and, additionally, a stabilization annealing stage comprising a conventional treatment for curing of lacquers and paints according to the norm UNE-EN 541:2008 (205° C., for 20 minutes).

Additionally, the method described herein may comprise further post-treatment stages such as degreasing, conversion coating and oiling, or the like. The final aluminium alloy sheet may be obtained as a coil or, alternatively, it can be cut to length in order to obtain separate sheet of a predetermined length.

The aluminium alloy sheet according to the invention may have a width range of 800-1300 mm in coil form, and 800-1250 mm in sheet form.

A further aspect of the present invention refers to an aluminium alloy sheet as described in this document, characterized in that this sheet is obtained or obtainable by the method according to the invention.

The final thickness of the aluminium alloy sheet may be lower than 0.190 mm, preferably from 0.1725 mm to 0.1875 mm, with the required properties to be used for closure of bottles, can and similar containers. Advantageously, the aluminium alloy sheet according to the invention can be deep drawing to get 30×60 mm wine type closures, maintaining the same rigidity and torque ranges after being applied to the bottle.

An additional aspect of the invention refers to the use of the aluminium alloy sheet defined in this document for manufacturing an aluminium closure, preferably an aluminium cap. These caps may be short caps such as screw cap or pilfer proof caps, or they may be long caps such as wine caps.

A further aspect of the instant invention refers to the aluminium closure comprising the aluminium alloy sheet defined in this document. In particular, these closures may be aluminium caps as those mentioned in the previous paragraph.

EXAMPLES

Figure 1:
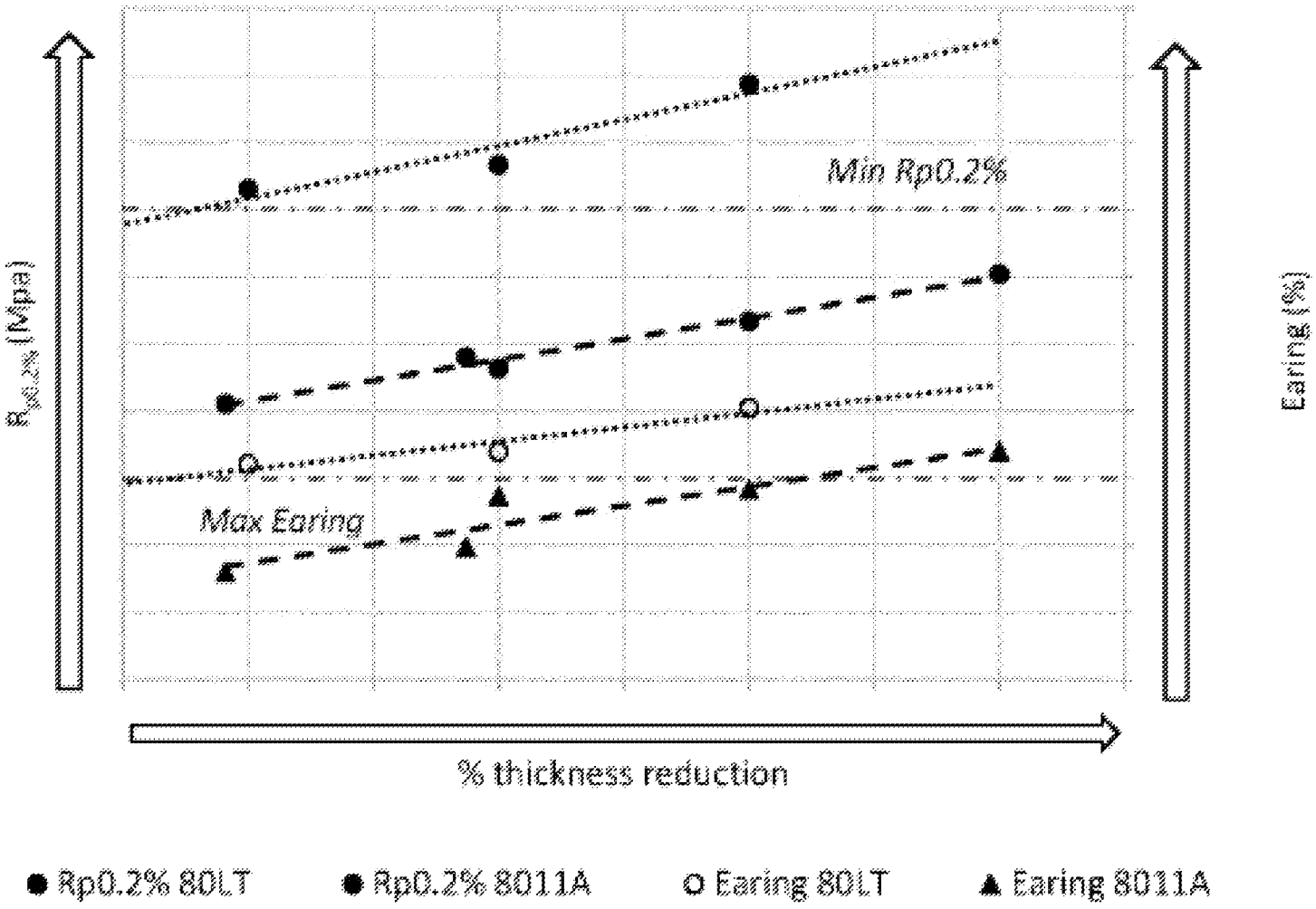
FIG. 1 shows the change in earing and yield strength (Rp0.2) of aluminium alloy sheets comprising either an aluminium alloy according to the invention (80LT) or an aluminium alloy according to 8011A, as the percentage of cold-rolling thickness reduction increases. Aluminium alloy sheets represented in this graph were obtained by a thermo-mechanical method not according to the invention, which does not comprise the sequences of cold rolling and recrystallization annealing stages described in this document.

In the following, the invention will be further illustrated by means of Examples. The Examples should in no case be interpreted as limiting the scope of the invention, but only as an illustration of the invention.

Example 1: Aluminium Alloy Sheet Obtained According to the Method of the Invention

TABLE 1

Chemical composition of the aluminum alloy sheet (80LT)

| Element | Si | Fe | Cu | Mn | Mg | Cr | Zn | Ti | Other total | Al |
|---|---|---|---|---|---|---|---|---|---|---|
| wt. % | 0.20 | 0.86 | 0.11 | 0.64 | 0.32 | 0.00 | 0.00 | 0.020 | <0.04 | balance |

First, an aluminum alloy ingot with the composition of table 1 (see above) was obtained by Direct Child Casting from aluminum scrap mixed with the required amounts of pure aluminum and alloying elements to obtain the desired chemical composition, so that the recycling content of the aluminum alloy ingot was 80%, according to IS014021: 2016.

The aluminum alloy ingot was homogenized by heating at a temperature of 540° C. for at least 4 hours.

Then, the homogenized aluminum alloy ingot was hot rolled until reaching a final temperature of 389° C. and a thickness reduction of 98.6%.

The hot rolled aluminum sheet was transferred in the form of a coil to a mill which work at a lower temperature, in particular, a temperature lower than 100° C., and the aluminum sheet obtained in the previous stage was cold-rolled to obtain the first cold-rolled aluminum sheet with a thickness reduction of 80±2%.

Then, the first cold-rolled aluminum sheet obtained in the form of a coil was heated in an oven until reaching a temperature of 330° C.±10° C., and was then maintained for 3 h±1 h at this temperature. After this time period, the first annealed sheet was removed from the oven.

The first annealed sheet obtained in the previous stage was transferred in the form of a coil to a mill which work at a lower temperature, in particular, a temperature lower than 100° C., and it was cold-rolled to obtain the second cold-rolled aluminum sheet with a thickness reduction of 70±2%.

Next, the second cold-rolled aluminum sheet obtained in the form of a coil was heated in an oven until reaching a temperature of 330° C.±10° C., and was then maintained for 3 h±1h at this temperature. After this time period, the second annealed sheet was removed from the oven.

The second annealed sheet obtained in the previous stage was transferred in the form of a coil to a mill which work at a lower temperature, in particular, a temperature lower than 100° C., and it was cold-rolled to obtain the third cold-rolled aluminum sheet with a thickness reduction of 50±2%.

Table 2 below illustrates the thickness, mechanical properties and earing for the aluminum alloy sheet obtained according to the method described in Example 1, including results after stoving simulation according to norm UNE-EN-541:2008 (205° C. for 20 minutes).

TABLE 2

Results of the aluminum alloy sheet according of the invention

| | Example 1 | Example 1 (after stoving simulation) | Method of measurement |
|---|---|---|---|
| Thickness | 0.18 mm | 0.18 mm | |
| Grain size | ≤70 μm | ≤70 μm | measured in the plane of the long transverse direction by interception method according to ASTM E-112 |
| Tensile strength (Rm) | 199 MPa | 186 MPa | UNE-EN ISO 6892-1: 2020 |
| Yield strength (Rp 0.2%) | 192 MPa | 164 MPa | |
| Elongation (A50) | 2.5% | 5.0% | |
| Earing | 2.8% | 2.8% | UNE-EN ISO 1669:1997 |
| Thickness | 0.18 mm | 0.18 mm | |
| Grain size | ≤70 μm | ≤70 μm | measured in the plane of the long transverse direction by interception method according to ASTM E-112 |
| Tensile strength (Rm) | 199 MPa | 186 MPa | UNE-EN ISO 6892-1: 2020 |
| Yield strength (Rp 0.2%) | 192 MPa | 164 MPa | |
| Elongation (A50) | 2.5% | 5.0% | |
| Earing | 2.8% | 2.8% | UNE-EN ISO 1669:1997 |

Comparative Example: Aluminium Alloy Sheet Obtained According to the Method of the Invention The same procedure described in Example 1 was used to manufacture an aluminum alloy sheet with the chemical composition of alloy 8011A.

TABLE 3

Chemical composition of the aluminum alloy sheet of alloy 8011A

| Element | Si | Fe | Cu | Mn | Mg | Cr | Zn | Ti |
|---|---|---|---|---|---|---|---|---|
| wt. % | 0.82 | 0.87 | 0.04 | 0.07 | 0.05 | 0.00 | 0.01 | 0.02 |

Table 4 below illustrates the thickness, mechanical properties and earing for the aluminum alloy sheet obtained in comparative Example 1, including results after stoving simulation according to norm UNE-EN-541:2008 (205° C. for 20 seconds).

TABLE 4

Results of the aluminum alloy sheet (comparative example)

| | Comparative Example | Comparative Example (after stoving simulation) | Method of measurement |
|---|---|---|---|
| Thickness | 0.18 mm | 0.18 mm | |
| Grain size | ≤70 μm | ≤70 μm | measured in the plane of the long transverse direction by interception method according to ASTM E-112 |
| Tensile strength (Rm) | 157 MPa | 141 MPa | UNE-EN ISO 6892-1: 2020 |
| Yield strength (Rp 0.2%) | 152 MPa | 126 MPa | |
| Elongation (A50) | 2.0% | 6.5% | |
| Earing | 2.9% | 2.7% | UNE-EN 1669:1997 |

These results prove that aluminum alloy sheets complying with the required properties, in particular, thickness, mechanical properties and earing can be obtained by the specific combination of the aluminum alloy composition and the thermomechanical manufacturing process according to the invention (see table 2, Example 1), but it was not possible to achieve the desired balance of the above-mentioned properties from aluminum alloys of a different composition (see table 4, Comparative Example 1). More specifically, results reported in table 4 prove that, when an alloy according to 8011A is used, the established minimum yield strength cannot be achieved, while maintaining earing lower than 3%.

Besides that, FIG. 1 shows preliminary results obtained during the development of the method for producing an aluminium alloy sheet. According to these results, the required minimum yield strength after stoving treatment (i.e., Rp0.2 minimum 150 MPa) could not be achieved in any of the experimental tests using the alloy according to 80111A as described in table 3 (see above) and, in particular, this minimum yield strength value could not be achieved while maintaining the earing below the maximum value of 3%.

Different to that, all three aluminium alloy sheets obtained from an aluminium alloy composition as defined in table 1 (see above), which were manufactured by the same thermomechanical process (not according to the invention), complied with the required minimum yield strength, whereas the required earing specification was almost achieved by the experimental test with the lowest percentage of thickness reduction.

Figure 2:
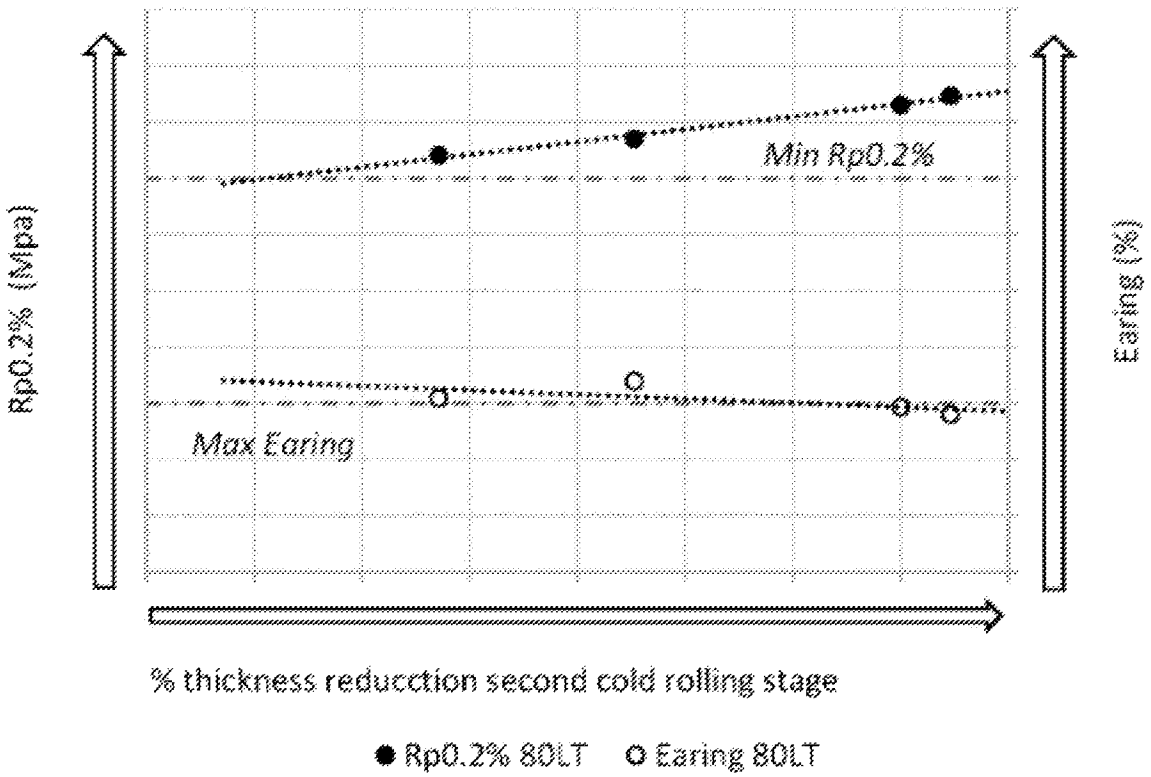
FIG. 2 shows the change in earing and yield strength (Rp0.2) of aluminium alloy sheet according to the invention (80LT), after stoving simulation (at 205° C., 20 minutes), as the percentage of thickness reduction in the second cold rolling stage increases.

After that, inventors found that the required balance of mechanical properties and earing could be achieved by including the specific sequence of cold rolling and annealing stages (i.e., stages d) to h)) in the thermomechanical process used in the above-mentioned preliminary studies, thus arriving to the method for producing an aluminium alloy sheet as described in this document. In this regard, FIG. 2 shows that three experimental tests using aluminium alloy composition according to the invention (80LT) have yield strengths higher than the established minimum value and, additionally, the test with the highest percentage of thickness reduction in the second cold rolling stage (i.e., the cold rolling stage between the two annealing treatments) also achieves earing lower than the maximum established value.

The invention claimed is:

1. An aluminium alloy sheet comprising:

an aluminium alloy, the aluminium alloy comprising:

0.15 wt. % to 0.25 wt. % of Si,
0.80 wt. % to 1.00 wt. % of Fe,
0.08 wt. % to 0.12 wt. % of Cu,
0.55 wt. % to 0.70 wt. % of Mn,
0.30 wt. % to 0.40 wt. % of Mg,
equal to or less than 0.05 wt. % of each other element, and
aluminium as balance, wherein the aluminium alloy sheet has an earing less than 3%, and wherein the aluminium alloy sheet has a tensile strength of 175 MPa to 215 MPa, a yield strength of 170 MPa to 210 MPa, and elongation equal to or higher than 2%.

2. The aluminium alloy sheet of claim 1, wherein the aluminium alloy comprises:

equal to or less than 0.03 wt. % of Cr,
equal to or less than 0.05 wt. % of Zn,
equal to or less than 0.03 wt. % of Ti, and
equal to or less than 0.03 wt. % of each other element, wherein the total amount of unspecified elements is equal to or less than 0.15 wt. %.

3. The aluminium alloy sheet of claim 1, wherein the aluminium alloy has a mass ratio of Fe/Si higher than 3.

4. The aluminium alloy sheet of claim 1, wherein the aluminium alloy sheet has a thickness equal to or lower than 0.190 mm.

5. The aluminium alloy sheet of claim 1, wherein the aluminium alloy comprises equal to or less than 0.03 wt. % of the each other element.

6. The aluminium alloy sheet of claim 4, wherein the thickness of the aluminium alloy sheet is of 0.1725 mm to 0.1875 mm.

7. The aluminium alloy sheet of claim 1, wherein the earing is less than 2.5%.

8. A method of making an aluminium alloy sheet comprising an aluminium alloy, the aluminium alloy comprising:

0.15 wt. % to 0.25 wt. % of Si,
0.80 wt. % to 1.00 wt. % of Fe,
0.08 wt. % to 0.12 wt. % of Cu,
0.55 wt. % to 0.70 wt. % of Mn,
0.30 wt. % to 0.40 wt. % of Mg,
equal to or less than 0.05 wt. % of each other element, and
aluminium as balance, the aluminium alloy sheet having an earing less than 3% and a tensile strength of 175 MPa to 215 MPa, a yield strength of 170 MPa to 210 MPa, and elongation equal to or higher than 2%;

the method comprising the steps of:

(a) obtaining an aluminium alloy ingot comprising the aluminium alloy;

(b) homogenizing the aluminium alloy ingot to form a homogenized ingot by heating the aluminium alloy ingot at a temperature of 530° C. to 610° C. for at least 4 hours;

(c) hot rolling the homogenized aluminium alloy ingot to form a hot rolled sheet, wherein the final hot rolling temperature is of 330° C. to 390° C.;

(d) a first cold rolling stage, wherein the hot rolled sheet is cold rolled to form a first cold rolled sheet, wherein the first cold rolling is done with a thickness reduction of 25% to 85%;

(e) a first recrystallization annealing stage, wherein the first cold rolled sheet is annealed at a temperature of 300° C. to 450° C. for 0.5 hours to 6 hours to form a first annealed sheet;

(f) a second cold rolling stage, wherein the first annealed sheet is cold rolled to form a second cold rolled sheet, wherein the second cold rolling is done with a thickness reduction of 25% to 85%;

(g) a second recrystallization annealing, wherein the second cold rolled sheet is annealed at a temperature of 300° C. to 450° C. for 0.5 hours to 6 hours to form a second annealed sheet; and (h) a third cold rolling stage, wherein the second annealed sheet is cold rolled to form a third cold rolled sheet, wherein the third cold rolling is done with a thickness reduction of 25% to 85%.

9. The method of claim 8, wherein the homogenizing treatment of stage (b) comprises heating the ingot at a temperature of 540° C. to 560° C. for a period of 4 h to 40 h.

10. The method of claim 8, wherein the final hot rolling temperature in stage (c) is of 360° C. to 390° C.

11. The method of claim 8, wherein the thickness reduction is of 60% to 85% in the first cold rolling stage (d), 60% to 85% in the second cold rolling stage (f), and 25% to 60% in the third cold rolling stage (h).

12. The method of claim 8, wherein the recrystallization annealing of one or more of stages (e) and (g) is carried out at a temperature from 320° C. to 360° C. for 2 h to 4 hours.

13. The method of claim 8, wherein the aluminium alloy of the aluminium alloy ingot comprises:

equal to or less than 0.03 wt. % of Cr, equal to or less than 0.05 wt. % of Zn, equal to or less than 0.03 wt. % of Ti, and equal to or less than 0.03 wt. % of each other element, wherein the total amount of unspecified elements is equal to or less than 0.15 wt. %.

14. The method of claim 8, wherein the aluminium alloy of the aluminium alloy ingot has a mass ratio of Fe/Si higher than 3.

15. The method of claim 8, further comprising the step of (i) stabilization annealing the third cold rolled sheet to form the final aluminium alloy sheet, wherein the annealing is at a temperature of 180° C. to 225° C. for 5-15 seconds.

16. The method of claim 8, wherein the produced aluminium alloy sheet has a tensile strength of 175 MPa to 215 MPa, a yield strength of 170 MPa to 210 MPa, and elongation equal to or higher than 2%.

17. The method of claim 8, wherein one, two or all three of the following is fulfilled in the method:

the hot rolled sheet is cold rolled in step (d) at a temperature lower than 100° C.;

the first annealed sheet is cold rolled in step (f) at a temperature lower than 100° C.; and the second annealed sheet is cold rolled in step (h) at a temperature lower than 100° C.

18. An aluminium closure comprising:

an aluminium alloy sheet comprising an aluminium alloy, the aluminium alloy comprising:

0.15 wt. % to 0.25 wt. % of Si, 0.80 wt. % to 1.00 wt. % of Fe, 0.08 wt. % to 0.12 wt. % of Cu, 0.55 wt. % to 0.70 wt. % of Mn, 0.30 wt. % to 0.40 wt. % of Mg, equal to or less than 0.05 wt. % of each other element, and aluminium as balance, wherein the aluminium alloy sheet has an earing less than 3%, and wherein the aluminium alloy sheet has a tensile strength of 175 MPa to 215 MPa, a yield strength of 170 MPa to 210 MPa, and elongation equal to or higher than 2%.

* * * * *